US006179418B1

(12) United States Patent
Mizoguchi et al.

(10) Patent No.: US 6,179,418 B1
(45) **Date of Patent: *Jan. 30, 2001**

(54) ELECTROSTATIC INK JET RECORDING APPARATUS THAT ADJUSTS THE AMOUNT OF HEAT BASED ON THE TYPE OF RECORDING MATERIAL

(75) Inventors: Tadashi Mizoguchi; Hitoshi Minemoto; Hitoshi Takemoto; Junichi Suetsugu; Kazuo Shima; Yoshihiro Hagiwara; Toru Yakushiji, all of Niigata (JP)

(73) Assignee: NEC Corporation, Tokyo (JP)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

(21) Appl. No.: 08/964,968

(22) Filed: Nov. 5, 1997

(30) Foreign Application Priority Data

Nov. 5, 1996 (JP) ..... 8-292744

(51) Int. Cl.[7] ..... B41J 2/01
(52) U.S. Cl. ..... 347/102; 347/105
(58) Field of Search ..... 118/691; 347/105, 347/55, 16, 102; 399/44, 69, 67, 388, 389

(56) References Cited

U.S. PATENT DOCUMENTS

| | | | | |
|---|---|---|---|---|
| 4,719,489 | * | 1/1988 | Ohkubo et al. | 399/69 |
| 5,109,236 | * | 4/1992 | Watanabe et al. | 346/76 |
| 5,130,726 | * | 7/1992 | Fukushima et al. | 346/140 |
| 5,208,628 | * | 5/1993 | Ohashi et al. | 399/69 |

FOREIGN PATENT DOCUMENTS

| | | | |
|---|---|---|---|
| 54-107735 | * | 8/1979 | (JP) . |
| 56-167473 | | 12/1981 | (JP) . |
| 62-101483 | * | 5/1987 | (JP) . |
| 5-220950 | | 8/1993 | (JP) . |
| 6-40605 | * | 2/1994 | (JP) . |
| 8-90525 | | 4/1996 | (JP) . |

* cited by examiner

*Primary Examiner*—Richard Moses
*Assistant Examiner*—Hoang Ngo

(57) ABSTRACT

Light of a light emitting portion is received by a total of two light receiving portions disposed opposite to each other through a record medium. The surface condition of the record medium is detected corresponding to the amount of light reflected and the amount of light transmitted so as to determine whether the record medium placed is plain paper, coated paper, OHP film, or the like. By controlling the number of heating elements of a heater or turning on/off the heater, an optimum fixing condition is accomplished.

22 Claims, 5 Drawing Sheets

ELECTROSTATIC INK JET RECORDING APPARATUS THAT ADJUSTS THE AMOUNT OF HEAT BASED ON THE TYPE OF RECORDING MATERIAL

BACKGROUND OF THE INVENTION

1. Field of the Invention

The present invention relates to an electrostatic ink jet recording apparatus, in particular, to an electrostatic ink jet recording apparatus with an ink of which toner particles dispersed in a carrier solution and sprayed by electrostatic electricity so as to record data.

2. Description of the Related Art

A variety of ink jet recording systems have been proposed because of their advantages such as direct recording on plain paper and low noise. As one of such systems, an ink recording head has been disclosed as Japanese Patent Laid-Open Publication No. 56-167473. With reference to FIG. 5, the structure of the related art reference will be described.

In an ink jet recorder, a large number of electrodes 42 are placed at an inner side of an ink jet port 41 of a recording head. An ink in the ink jet port 41 is selectively jetted through the selective by selectively applying a high voltage pulse between the electrodes 42 and a grounded conductor 49 at the side of record paper 50 corresponding to a picture signal. In the ink jet recorder, the ink jet port 41 is divided into an upper part 41*a* and a lower part 41*b* with a partition 45 in the slit-form jet port 41, which is formed with an upper plate 46 and a lower plate 47. A large number of electrodes 42 are disposed at the inside of divided jet ports 41*a* and 41*b* (upper plate and lower plate surfaces and/or the surfaces of the divided plates). By applying a high voltage to some electrodes and a low voltage to an electrode positioned on the right or left of the electrode, jetted ink dot moves to the high voltage side.

An ink placed in an ink chamber 44 reaches an ink ejection port 41. The ink at the ink jet port 41 forms a linear meniscus. When a high voltage of around 2 kV is applied from a terminal 48 to a selected electrode 42, the ink is jetted from the position of the electrode at which such a high voltage is applied. The ink is accelerated by an electric field with a conductive roller 49 and then adhered to record paper 50. Thus, by selecting a plurality of electrodes and applying a high voltage thereto at the same time, a pattern of one line can be recorded. With the record paper 50 moved, characters, figures, and so forth can be recorded as dots of the ink.

Another related art reference that has been disclosed as PCT Laid-Open Publication NO. WO 93/11866 is an electrostatic ink jet recording apparatus. The apparatus comprises an electrostatic ink jet recording head and a counter electrode. The counter electrode causes an electric field to be formed with a counter electrode against the ink jet recording head disposed on the rear surface of the record paper. The ink jet recording head has an ink chamber and an ejection electrode. The ink chamber temporarily stores an ink solution supplied from an ink tank or the like. The ejection electrode is disposed at an edge portion of the ink chamber. The ink jet recording head is disposed opposite to the counter electrode. The ink solution in the ink chamber is supplied to the edge of the ejection electrode due to the surface tension. Thus, an ink meniscus is formed at the edge of the ejection electrode. The ink solution used for the ink jet recording head contains a coloring charge particles. The charge particles are positively charged with a zeta voltage. When a positive voltage is applied to the discharge electrode, the voltage of the positive electrode of the ink solution increases. When Coulomb force that works between the charge particles at the edge of the ejection electrode and the counter electrode largely exceeds the surface tension of the ink solution, agglomeration of the charge particles with a small amount of ink solution is jetted from the edge position of the ejection electrode to the counter electrode. The charge particles adhere to the front surface of the record medium. In such a manner, with the voltage to the ejection electrode, agglomeration of the charge particles is successively jetted from the edge of the election electrode to the front surface of the record medium and thereby data is recorded.

The diameter of the toner particles is on the order of several microns. Thus, jetted toner particles stably adhere in fibers of plain paper that is normally used as a record medium. Consequently, a heat fixing process for heating and pressuring toner particles on the record medium is not required unlike with a fixing means used in a dry electrophotographic apparatus. In the related art reference, the toner can be fixed with only hot air. This is one advantage over the conventional electrophotographic apparatus with a dry toner.

In the conventional electrostatic ink jet recording apparatus, when the front surface of a record medium is smooth as with coated paper or when the front surface of the record medium is very smooth and the toner particles do not adhere in fibers of the record medium as with an OHP film, the toner particles that adhere on the record medium are easily removed and thereby a fixing failure takes place.

As a means for solving such a problem, a heat fixing unit may be used as with the conventional electrophotographic apparatus with a dry toner.

However, as was described above, with the electrostatic ink jet recording apparatus, the toner can be easily fixed by blowing a small amount of hot air. In addition, the power consumption of the electrostatic ink jet recording apparatus is much smaller than that of the conventional electrophotographic apparatus. Thus, as with the electrophotographic apparatus with a dry toner, the method using the heat fixing unit that requires hot air deteriorates the advantage of the electrostatic ink jet recording apparatus front a view point of the power consumption.

SUMMARY OF THE INVENTION

An object of the present invention is to provide an electrostatic ink jet recording apparatus that can properly fix a toner corresponding to the surface condition of a record medium and that does not excessively consume the electric power.

An electrostatic ink jet recording apparatus according to the present invention comprises a surface condition detecting means for detecting the surface condition of the record medium, a surface condition determining means for determining the detected surface condition, a heat amount controlling means for controlling the amount of heat radiated to the front surface of the record medium corresponding to the determined result, and a heater driving portion controlled by controlling means.

In the electrostatic ink jet recording apparatus according to the present invention, the surface condition detecting means may have one light emitting portion and a total of two light receiving portions as a first light receiving portion and a second light receiving portion, the first light receiving portion being disposed on the same side as the light emitting portion against the record medium, the second light receiving portion being disposed opposite side to the first light receiving portion through the record medium.

The electrostatic ink jet recording apparatus according to the present invention may further comprise a heater radiated to the front surface of the record medium, the heater having a plurality of heating elements, wherein the heat amount controlling means controls the number of the heating elements so as to control the amount of heat radiated to the front surface of the record medium.

In the electrostatic ink jet recording apparatus according to the present invention, the heat amount controlling means may control the amount of heat radiated to the front surface of the record medium by turning on/off the heater.

The electrostatic ink jet recording apparatus according to the present invention may further comprise a fixing means for fixing the toner particles on the record medium corresponding to the determined result of the surface condition determining means.

The electrostatic ink jet recording apparatus according to the present invention may further comprise an ambient temperature detecting means for detecting an ambient temperature in the vicinity of the record medium, wherein the fixing means is driven corresponding to the detected result of the ambient temperature detecting means.

The electrostatic ink jet recording apparatus according to the present invention may further comprise an ambient humidity detecting means for detecting an ambient humidity in the vicinity of the record medium, wherein the fixing means is driven corresponding to the detected result of the ambient humidity detecting means.

These and other objects, features and advantages of the present invention will become more apparent in light of the following detailed description of best mode embodiments thereof, as illustrated in the accompanying drawings.

DESCRIPTION OF PREFERRED EMBODIMENTS

Figure 1:
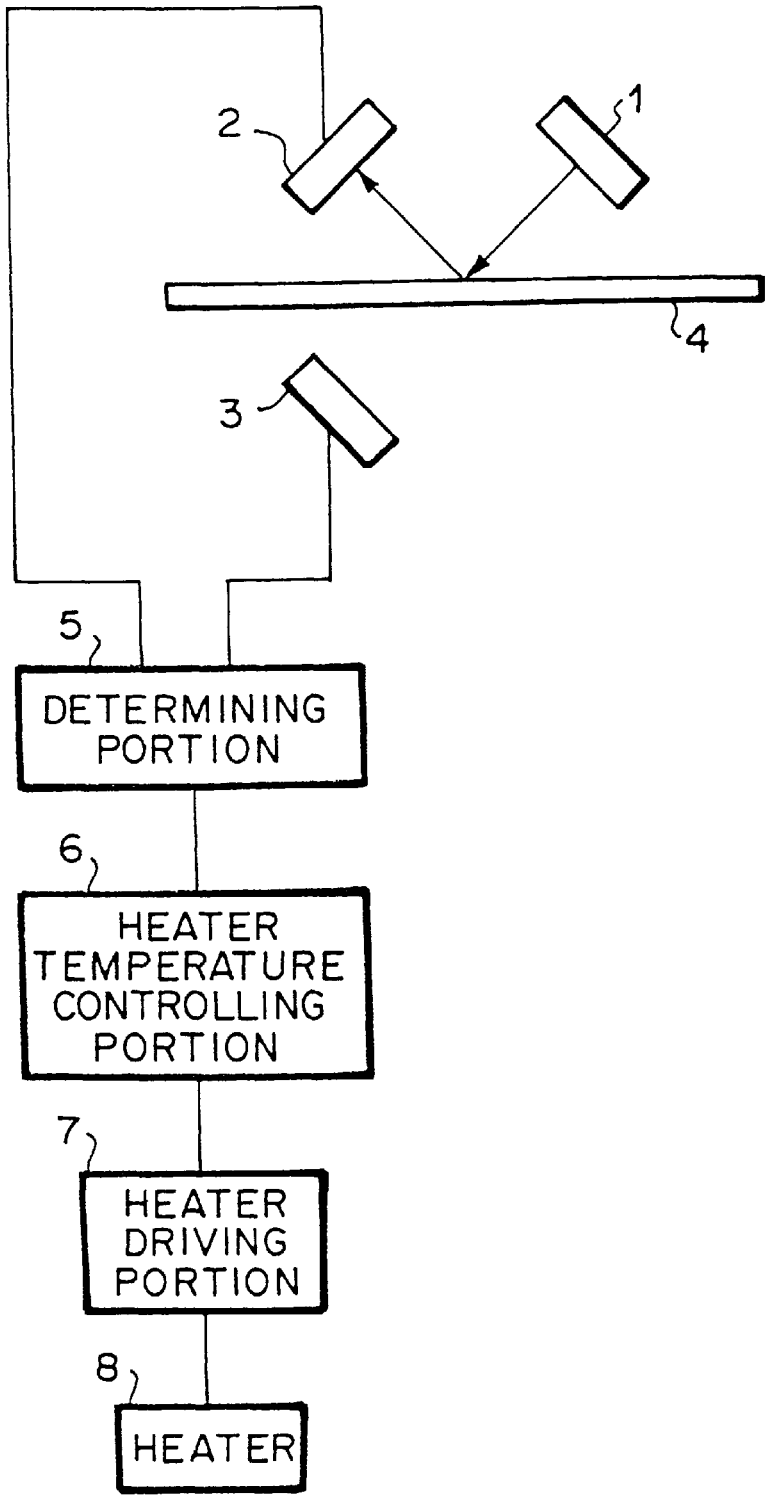
FIG. 1 is a block diagram showing the structure of an electrostatic ink jet recording apparatus according to a first embodiment of the present invention.

FIG. 1 is a block diagram showing the structure of an electrostatic ink jet recording apparatus according to a first embodiment of the present invention. Referring to FIG. 1, as a means for detecting the surface condition of a record medium 4, the electrostatic ink jet recording apparatus has a light emitting portion 1, a light receiving portion 2, a light receiving portion 3, and a determining portion 5. The light emitting portion 1 emits light to the record medium 4. The light receiving portion 2 is disposed on the same side as the light emitting portion 1 against the record medium 4. The light receiving portion 1 receives light that is emitted from the light emitting portion 1 and reflected on the front surface of the record medium 4. The light receiving portion 3 is disposed opposite to the light emitting portion 1 through the record medium 4. The light receiving portion 3 receives light that is emitted from the light emitting portion 1 and transmitted through the record medium 4. The determining portion 5 receives output signals of the light receiving portion 2 and the light receiving portion 3 and determines the surface condition of the record medium 4.

Figure 2A:
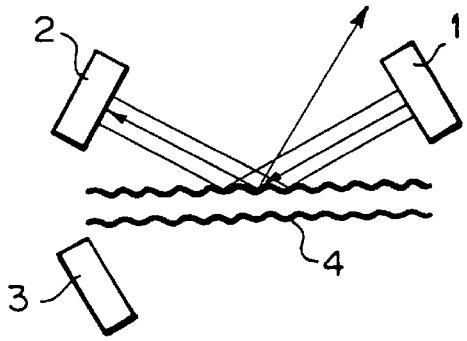
FIGS. 2A, 2B, and 2C are schematic diagrams showing operations of a light emitting portion 1, a light receiving portion 2, and a light receiving portion 3.
Figure 2B:
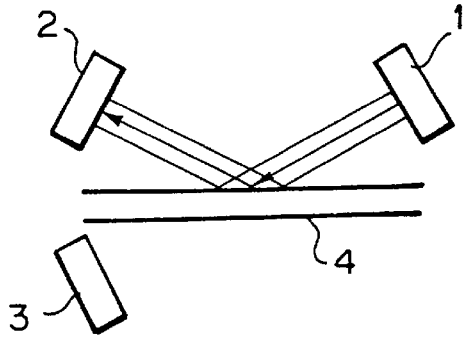
Figure 2C:
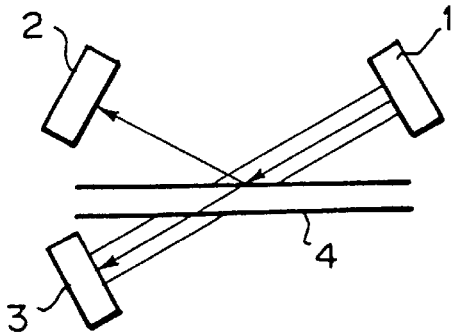

FIGS. 2A, 2B, and 2C are schematic diagrams showing operations of the light emitting portion 1, the light receiving portion 2, and the light receiving portion 3. FIG. 2A shows the case that reflected light is uneven (namely, the record medium 4 is a so-called plain paper). Since the front surface of the paper is rough, the light emitted from the light emitting portion 1 is scattered. The light receiving portion 2 receives weakened light. FIG. 2B shows the case that the front surface of the record medium 4 is smooth. Since the front surface of the paper is smooth, most of the light emitted from the light emitting portion 1 is received as reflected light by the light receiving portion 2. FIG. 2C shows the case that the record medium 4 is an OHP film. Since the light emitted from the light emitting portion 1 is transmitted through the record medium 4, most of the light is received by the light receiving portion 3.

The determination criteria of the determining portion 5 are designated as the following examples. When the amount of light received by the light receiving portion 2 against the amount of light emitted is 90% or less, the determining portion 5 determines that the record medium 4 is plain paper. When the amount of light received by the light receiving portion 2 against the amount of light emitted is 90% or more, the determining portion 5 determines that the front surface of the record medium 4 is smooth as with coated paper. When the amount of light received by the light receiving portion 2 is as small as several % and the amount of light received by the light receiving portion 3 is 80% or more, the determining portion 5 determines that the record medium is an OHP film. When the amount of light received by the light receiving portion 2 is 0% and the amount of light received by the light receiving portion 3 is 95% or more, the determining portion 5 determines that no paper is placed. It should be noted that these values are just examples. Thus, these values vary corresponding to the types of the light emitting portion 1 and the light receiving portions 2 and 3.

Figure 3:
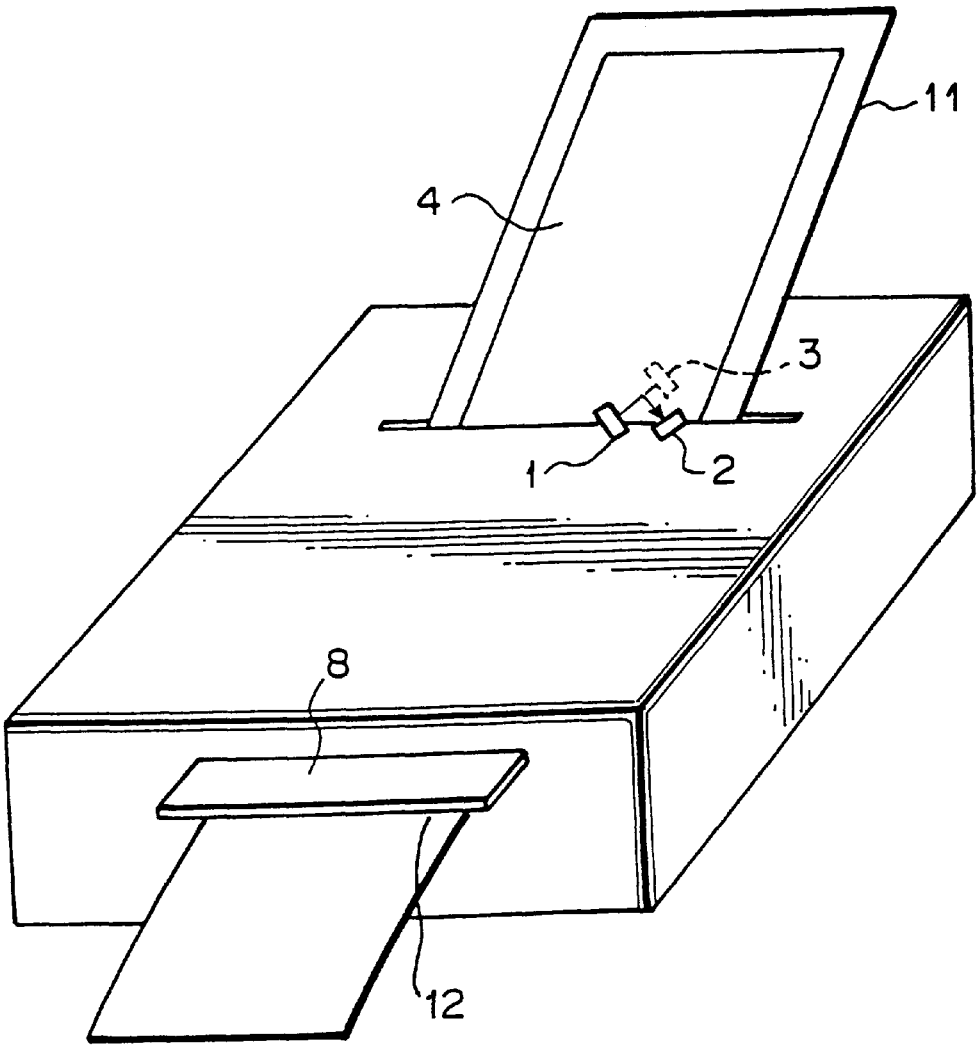
FIG. 3 is a perspective view showing the positions of the light emitting portion 1, the light receiving portion 2, and the light receiving portion 3.

FIG. 3 is a perspective view showing positions of the light emitting portion 1, the light receiving portion 2, and the light receiving portion 3. The record medium 4 is placed in a paper feed portion 11. The record medium 4 is supplied to a recording head portion (not shown) and then data is printed thereby. The printed paper is sent to a paper exit portion 12. In FIG. 3, the light emitting portion 1, the light receiving portion 2, and the light receiving portion 3 are disposed at the paper feed portion 11. The determining portion 5 determines the type of the record medium 4 with digital signals of which analog signals that are output from the light receiving portion 2 and the light receiving portion 3 by an A/D converter (not shown) under the control of a microcomputer (not shown). The analog signals that are output from the light receiving portions 2 and 3 are compared with reference values such as 80% or 90% of the amount of light emitted by a comparator.

In FIG. 3, for simplicity, the light emitting portion 1, the light receiving portion 2, the light receiving portion 3, and the heater 8 are shown outside the apparatus. However, actually, they are disposed inside the apparatus.

A heater temperature controlling portion 6 shown in FIG. 1 varies the amount of heat of the heater 8 corresponding to information of the surface condition of the record medium 4 determined by the determining portion 5. When the determined result of the determining portion 5 is plain paper, the heater driving portion 7 drives one heating element of the heater 8. When the determined result of the determining portion 5 is a smooth record medium, the heater driving portion 7 drives two heating elements of the heater 8. When the determined result of the determining portion 5 is an OHP film, the heater driving portion 7 drives four heating elements of the heater 8. Thus, the amount of heat radiated to the record medium 4 is varied corresponding to the surface condition of the record medium 4. Alternatively, with a temperature sensor disposed in the heater 8, the heater 8 may be turned on corresponding to information received from the temperature sensor so as to vary the heater temperature corresponding to the surface condition of the record medium 4.

Figure 4:
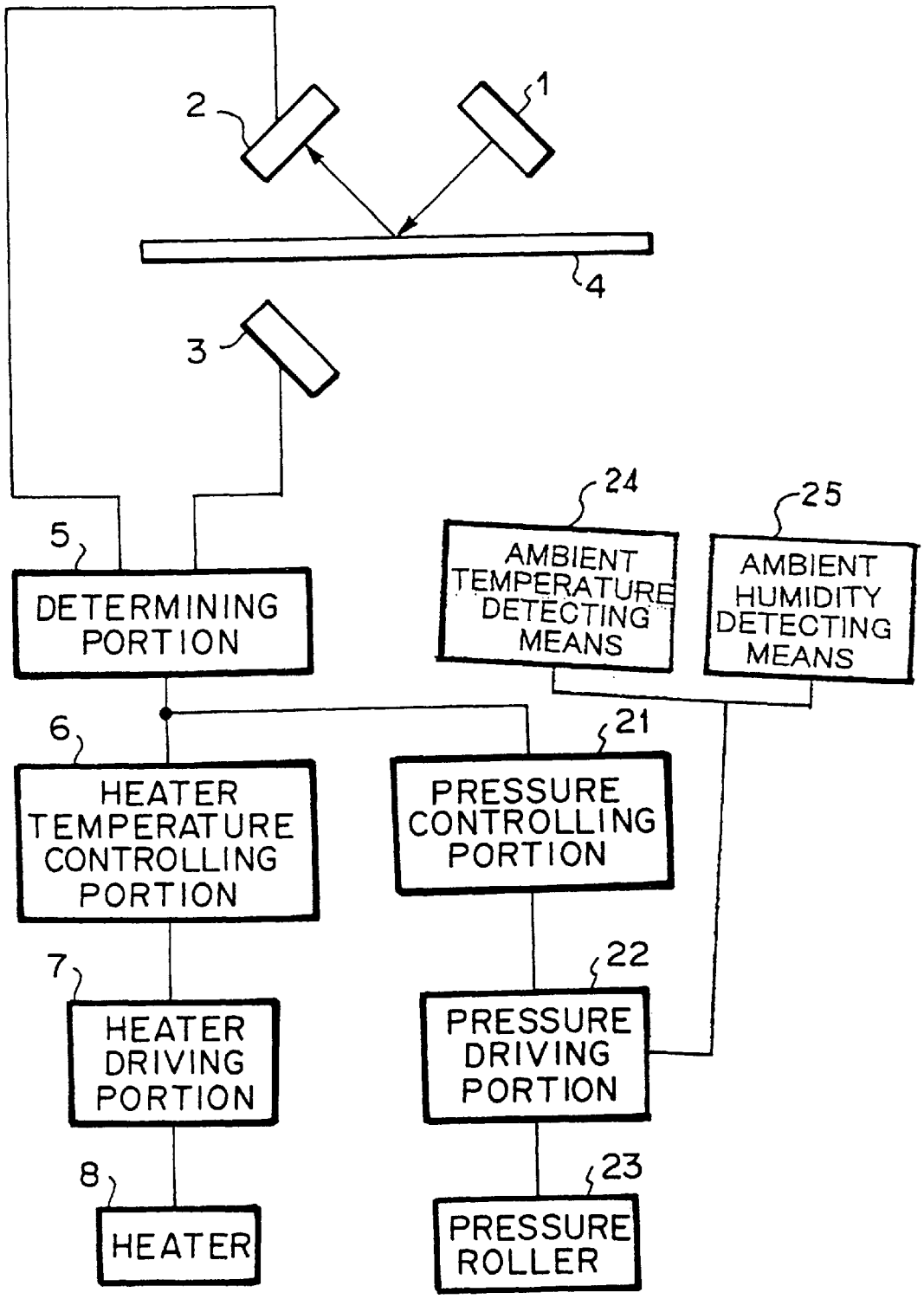
FIG. 4 is a block diagram showing the structure of an electrostatic ink jet recording apparatus according to a second embodiment of the present invention.
Figure 5:
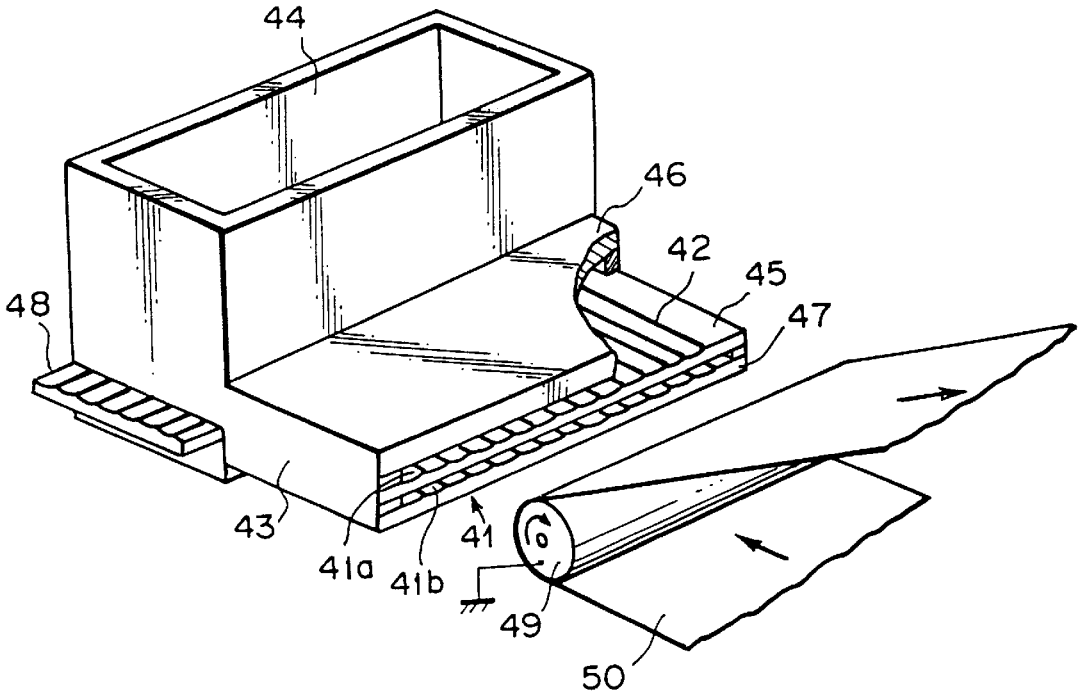
FIG. 5 (PRIOR ART)
FIG. 5 is a perspective view showing a conventional ink jet recording apparatus.

FIG. 4 is a block diagram showing an electrostatic ink jet recording apparatus according to a second embodiment of the present invention. Referring to FIG. 4, in addition to the control of the heater temperature, a pressure controlling portion 21 causes a pressure driving portion 22 to drive a pressure roller 23 corresponding to the determined result of the determining portion 5. When the record medium 4 is plain paper or smooth paper, the pressure controlling portion 21 does not cause the pressure driving portion 22 to drive the pressure roller 23. When the record medium 4 is an OHP film, the pressure controlling portion 21 causes the pressure driving portion 22 to drive the pressure roller 23. Thus, a toner can be actively fixed to an OHP film.

In this embodiment, when the front surface of the record medium 4 is smooth, the pressure roller 23 is not driven. However, it should be noted that the pressure roller 23 may be driven in such a case. In addition, the intensity of the pressure may be varied.

In addition, with a means for detecting the ambient temperature 24 or ambient humidity 25 in the vicinity of the record medium 4, when the pressure roller 23 is driven corresponding to the detected temperature or humidity, data can be more effectively printed.

As described above, according to the present invention, the surface condition of the record medium is detected and determined. In addition, the heater temperature is varied and/or the pressure is applied. Thus, data can be properly fixed on the record medium. Moreover, data can be fixed with optimum power consumption.

Although the present invention has been shown and described with respect to best mode embodiments thereof, it should be understood by those skilled in the art that the foregoing and various other changes, omissions, and additions in the form and detail thereof may be made therein without departing from the spirit and scope of the present invention.

What is claimed is:

1. An electrostatic ink jet recording apparatus comprising:

an ink containing charged toner particles;

an ink chamber storing the ink and having an ejection opening portion at an edge portion thereof;

an ejection electrode for ejecting the toner particles from the ejection opening portion;

an opposite electrode disposed opposite to the ejection opening portion through a record medium;

surface condition detecting means for directly detecting the surface condition of the record medium;

surface condition determining means for determining the detected surface condition of the record medium;

heat amount controlling means for variably increasing or decreasing the amount of heat radiated by a heater having a plurality of heating elements to the front surface of the record medium corresponding to the determined result; and a heater driving portion controlled by said heat amount controlling means for supplying heat the amount of heat to said record medium so as to vary a heater temperature corresponding to the surface condition of said record medium and driving said heater.

2. The electrostatic ink jet recording apparatus as set forth in claim 1, wherein said surface condition detecting means has one light emitting portion and a total of two light receiving portions as a first light receiving portion and a second light receiving portion, the first light receiving portion being disposed on the same side as the light emitting portion against the record medium, the second light receiving portion being disposed opposite to the first light receiving portion through the record medium.

3. The electrostatic ink jet recording apparatus as set forth in claim 1, further comprising:

a heater radiated to the front surface of the record medium, the heater having a plurality of heating elements, wherein said heat amount controlling means controls the number of the heating elements so as to control the amount of heat radiated to the front surface of the record medium.

4. The electrostatic ink jet recording apparatus as set forth in claim 2, further comprising:

a heater radiated to the front surface of the record medium, the heater having a plurality of heating elements, wherein said heat amount controlling means controls the number of the heating elements so as to control the amount of heat radiated to the front surface of the record medium.

5. The electrostatic ink jet recording apparatus as set forth in claim 1, wherein said heat amount controlling means controls the amount of heat radiated to the front surface of the record medium by turning on/off the heater.

6. The electrostatic ink jet recording apparatus as set forth in claim 2, wherein said heat amount controlling means controls the amount of heat radiated to the front surface of the record medium by turning on/off the heater.

7. The electrostatic ink jet recording apparatus as set forth in claim 1, further comprising:

fixing means for fixing the toner particles on the record medium corresponding to the determined result of said surface condition determining means.

8. The electrostatic ink jet recording apparatus as set forth in claim 2, further comprising:

fixing means for fixing the toner particles on the record medium corresponding to the determined result of said surface condition determining means.

9. The electrostatic ink jet recording apparatus as set forth in claim 3, further comprising:

fixing means for fixing the toner particles on the record medium corresponding to the determined result of said surface condition determining means.

10. The electrostatic ink jet recording apparatus as set forth in claim 5, further comprising:

fixing means for fixing the toner particles on the record medium corresponding to the determined result of said surface condition determining means.

11. The electrostatic ink jet recording apparatus as set forth in claim 7, further comprising:

ambient temperature detecting means for detecting an ambient temperature in the vicinity of the record medium, wherein the fixing means is driven corresponding to the detected result of the ambient temperature detecting means.

12. The electrostatic ink jet recording apparatus as set forth in claim 8, further comprising:

ambient temperature detecting means for detecting an ambient temperature in the vicinity of the record medium, wherein the fixing means is driven corresponding to the detected result of the ambient temperature detecting means.

13. The electrostatic ink jet recording apparatus as set. forth in claim 9, further comprising:

ambient temperature detecting means for detecting an ambient temperature in the vicinity of the record medium, wherein the fixing means is driven corresponding to the detected result of the ambient temperature detecting means.

14. The electrostatic ink jet recording apparatus as set forth in claim 10, further comprising:

ambient temperature detecting means for detecting an ambient temperature in the vicinity of the record medium, wherein the fixing means is driven corresponding to the detected result of the ambient temperature detecting means.

15. The electrostatic ink jet recording apparatus as set forth in claim 7, further comprising:

ambient humidity detecting means for detecting an ambient humidity in the vicinity of the record medium, wherein the fixing means is driven corresponding to the detected result of the ambient humidity detecting means.

16. The electrostatic ink jet recording apparatus as set forth in claim 11, further comprising:

ambient humidity detecting means for detecting an ambient humidity in the vicinity of the record medium, wherein the fixing means is driven corresponding to the detected result of the ambient humidity detecting means.

17. The electrostatic ink jet recording apparatus as set forth in claim 8, further comprising:

ambient humidity detecting means for detecting an ambient humidity in the vicinity of the record medium, wherein the fixing means is driven corresponding to the detected result of the ambient humidity detecting means.

18. The electrostatic ink jet recording apparatus as set forth in claim 12, further comprising:

ambient humidity detecting means for detecting an ambient humidity in the vicinity of the record medium, wherein the fixing means is driven corresponding to the detected result of the ambient humidity detecting means.

19. The electrostatic ink jet recording apparatus as set forth in claim 9, further comprising:

ambient humidity detecting means for detecting an ambient humidity in the vicinity of the record medium, wherein the fixing means is driven corresponding to the detected result of the ambient humidity detecting means.

20. The electrostatic ink jet recording apparatus as set forth in claim 13, further comprising:

ambient humidity detecting means for detecting an ambient humidity in the vicinity of the record medium, wherein the fixing means is driven corresponding to the detected result of the ambient humidity detecting means.

21. The electrostatic ink jet recording apparatus as set forth in claim 10, further comprising:

ambient humidity detecting means for detecting an ambient humidity in the vicinity of the record medium, wherein the fixing means is driven corresponding to the detected result of the ambient humidity detecting means.

22. The electrostatic ink jet recording apparatus as set forth in claim 14, further comprising:

ambient humidity detecting means for detecting an ambient humidity in the vicinity of the record medium, wherein the fixing means is driven corresponding to the detected result of the ambient humidity detecting means.

* * * * *